US006481663B2

(12) United States Patent
Hendrix

(10) Patent No.: US 6,481,663 B2
(45) Date of Patent: Nov. 19, 2002

(54) PROCESS FOR SEVERING A MATERIAL WEB AND REELING DEVICE FOR WINDING A MATERIAL WEB

(75) Inventor: Gottfried Hendrix, Wesel (DE)

(73) Assignee: Voith Paper Patent GmbH, Heidenheim (DE)

( * ) Notice: Subject to any disclaimer, the term of this patent is extended or adjusted under 35 U.S.C. 154(b) by 4 days.

(21) Appl. No.: 09/788,531

(22) Filed: Feb. 21, 2001

(65) Prior Publication Data

US 2001/0015394 A1 Aug. 23, 2001

(30) Foreign Application Priority Data

Feb. 21, 2000 (DE) ..... 100 07 833

(51) Int. Cl.[7] ..... B65H 35/08
(52) U.S. Cl. ..... 242/526; 225/4; 225/93
(58) Field of Search ..... 242/526; 225/4, 225/93, 97, 103, 104, 105

(56) References Cited

U.S. PATENT DOCUMENTS 4,304,368 A * 12/1981 Bartmann ..... 242/526
4,946,086 A * 8/1990 Suuronen et al. ..... 225/93

FOREIGN PATENT DOCUMENTS

| | | |
|---|---|---|
| DE | 19926913 | 1/2000 |
| EP | 0708049 | 4/1996 |
| EP | 0716997 | 6/1996 |

* cited by examiner

*Primary Examiner*—John Q. Nguyen
(74) *Attorney, Agent, or Firm*—Greenblum & Bernstein, P.L.C.

(57) ABSTRACT

Device and process for severing a material web. The process includes winding the material web onto a reel and severing the material web using an expanding device. The device includes an expandable device for severing the material web, wherein the device is adapted to sever the material web after the material web is wound onto the reel.

31 Claims, 2 Drawing Sheets

PROCESS FOR SEVERING A MATERIAL WEB AND REELING DEVICE FOR WINDING A MATERIAL WEB

CROSS-REFERENCE TO RELATED APPLICATIONS

The present application claims priority under 35 U.S.C. §119 of German Patent Application No. 100 07 833.8, filed on Feb. 21, 2000, the disclosure of which is expressly incorporated by reference herein in its entirety.

BACKGROUND OF THE INVENTION

1. Field of the Invention

The invention relates to a process for severing a material web, and particularly severing the material web after the material web is wound onto a winding reel. The invention also relates to a reeling device for rolling a material web into a winding reel using at least one roll which is in contact with the winding reel and a severing device.

2. Discussion of Background Information

Paper webs are typically produced more or less continuously. They must be wound into rolls so that they can be handled later by a consumer. Such rolls, e.g., winding reels, have widths in the range of 0.3 to 3.8 m and diameters in the range of 0.8 to 2.5 m. As a result, they have a limited capacity in regards to storing the wound web. Thus, it is necessary from time to time to cut the material web after the winding reel has reached the desired final diameter. Moreover, the cutting of the web necessarily requires that an end of the cut paper web created thereby be fixed onto the winding reel to prevent its unwinding. Further, the other cut end of the paper web, i.e, a new beginning end, must then be fixed to a new roll core so that the new roll can be wound in a similar manner.

For this purpose, it is known to create a perforation line in the paper web, i.e., so as to weaken the web, before an actual or real separation point is reached. The winding reel is then rolled further and continues to pull the paper web onto itself until the perforation line reaches the desired separation point. Then, the paper web is held while the winding reel is removed from its winding position. This movement causes the paper web to tear along the perforation line, i.e., the web experiences tension and/or stretching until it is caused to tear along at its weakest point which happens to be the perforation line.

This process has essentially been proven. However, the process can only be used on webs having up to a certain basis weight of about 100 to 130 g/m$^2$. Beyond that, webs cannot be severed with the aid of perforations with the necessary degree of reliability. Another disadvantage is that creating the perforations is relatively labor-intensive and thus expensive.

SUMMARY OF THE INVENTION

The invention therefore provides a device and method for the severing of a material web in a simple fashion largely independent of its basis weight.

The invention also provides for a device and a process which introduces an explosive and/or an explosive device (throughout the application explosive and explosive device are used interchangeably) between the material web and the winding reel and thereafter expanding the explosive device.

The explosive device may be rolled in between the winding reel and the outermost material web layer. The invention takes advantage of a design such that when the explosive device expands, there is essentially no space available for expanding the explosive device. As a result, the expansion of the explosive device causes the area of the web adjacent the explosive device to be destroyed at its "weakest" point. This area is the outermost layer of the material web. The material web is therefore ripped by the expansion of the explosive device, i.e., causing the web to tear. This finally results in a complete tearing through, i.e., a severing of the material web.

Preferably, the explosive device is introduced through a nip between a winding reel and a roll that is in contact with the winding reel, such that the material web is located in between. The explosive device is then expanded in an area behind the nip. This design also provides for the winding reel to squeeze the incoming material web between itself and the roll. Thus, when the explosive device expands, the space necessary for the expansion can be enlarged only by providing more material web. This design also fixes the material web. This has two advantages. On the one hand, the precision of the severing process is increased and, on the other hand, the position at which the separation occurs is better defined.

Advantageously, a reusable explosive device is used. This eliminates the exchange process after each separation process.

Preferably, the explosive device is a hose which is positioned laterally to the material web and is expanded by being inflated. The risk of damaging the winding reel in lower layers of the material web is comparatively low with such an inflatable hose. When the hose is inflated, the web is caused to rip at the point where it is the outermost material web layer of the winding reel. This is because this is the weakest point of the web. This design produces no remarkable observable negative effects on the winding reel or the web layers underneath the outermost layer.

The inflation preferably occurs abruptly. However, the inflation or the expansion may also occur slowly. This is because the paper web has only limited elasticity. As a result, as soon as the elasticity limit is reached, the web tears. However, the separation process may improve the faster the inflation occurs. This is because a separation of the material web occurs always when the expansion speed exceeds the maximal stretching speed of the material web. With an abrupt inflation speed, even material webs that are stretchable to a certain extent can be separated. In particular, in stronger materials, e.g., paper or cardboard with a basis weight of more than 120 g/m$^2$, abrupt inflation has been performed successfully.

Preferably, the explosive device is moved away from the winding reel after the separation of the material web. In this way, more than merely the material web is separated, i.e., the beginning of the material web and the end of the material web may also be spatially separated from one another so that subsequent processing is facilitated.

The invention also provides for a winding device in which the severing device has an explosive device which can be rolled and/or placed between the material web and the winding reel so that it can be expanded there.

As explained above, the explosive device is expandable so that it can tear through the uppermost layer of the material web on the winding reel. This design takes advantage of the uppermost layer being the weakest point adjacent the area of the explosive device. Thus, it is possible to reliably sever even thicker material webs utilizing this design. Astonishingly, the resulting tear edge can be relatively "clean" using this design. Moreover, while the tear cannot properly be characterized as a straight tear line, nevertheless, it is not truly lacerated either.

Preferably, the explosive device is embodied as a hose that can be filled with air. Such a hose has the advantage that it forms a reusable explosive. In most production facilities, compressed air is available, so that only relatively few additionally mechanisms are needed for implementing the severing process per se.

Preferably, the explosive device is positioned on holding arms which can be tensed and/or moved by rotating the winding reel. The explosive device is positioned between the uppermost layer of the material web and the circumference of the winding reel during a rotational movement of the winding reel. Moreover, the invention may provide that during this movement, the holding arms are stretched so that the explosive device may be automatically retracted in the direction of the tension after the separation of the material web. The explosive device can be utilized at the same time to lift the beginning of the severed material web off the circumference of the winding reel. For example, this may be advantageous when an adhesive is applied to the material web before the material web is severed. Such a design means that it is then no longer necessary to pay so much attention to the separation line running outside of the sticky area. Thus, even if some adhesive remains behind the explosive device, i.e., at the beginning of the new material web, the material web will be lifted off the circumference of the material web very reliably when the explosive device is retracted.

According to one embodiment, it is preferred for the holding arms to be pivoted around the axis of the roll. This ensures, on the one hand, that the explosive device can be retracted over the roll so as to be synchronized with the material web during the transportation of the material web. Such a design minimizes the amount of friction, which could damage the material web, that may occur between the material web and the explosive device. When the rotation is continued, the material web will separate from the surface of the roll and thus carry the explosive device along and therefore stretch the arms. When the separation occurs by expanding the explosive device, the explosive device can be retracted back to the roll so that it moves the beginning of the material web there.

According to one embodiment, it may be particularly advantageous for the explosive device to fix the material web to the roll after separation. The explosive may not only be used to sever the material web and to lift it off the surface of the winding reel, but it may also serve to fix the beginning of the material web onto the roll. Thereafter, the winding reel can be removed from the roll, e.g., with the aid of an ejection device, and then a new winding core for contacting the beginning of the material web can be introduced. Afterwards, the explosive device can be moved away from the material web or vice versa.

According to one embodiment, the roll is preferably at least one support roll of a double support rolling device. A winding bed is also provided. Moreover, the explosive device may be connected to a control device which may engage the expansion in the winding bed. The winding reel may be placed in the winding bed wherein the winding bed has two supports. The uppermost layers of the material web are fixed onto two support rolls by virtue of the weight of the winding reel. According to this embodiment, the expansion of the explosive device occurs in the winding bed, so that there is practically no chance that the material web can be fed from any of the two sides. Accordingly, the web is squeezed and/or clamped between the winding reel and the two support rolls. This design achieves a very reliable separation of a material web exactly where it is desired.

According to one embodiment, the invention provides for the placement of an expandable tube into a wedge-shaped opening between an almost-completely wound winding reel and the approaching paper web. The tube may then be positioned between the winding roll and the uppermost paper layer. This may occur at a creep speed of e.g., approximately 5 to 10 m/min (meters/minute). As soon as the tube is past the nip between the winding reel and the first carrying roll and located approximately at the lowest position of the winding reel, the tube can be blown-up or expanded with pressure, e.g., a pressure of approximately 6 bar. As a result or the tube being enlarged or expanded, the paper web is torn bit by bit across the width of the winding roll. The web may be torn within a specific period of time, e.g., may be torn in less than 60 seconds across the entire winding roll.

The expansion speed or rate can be varied depending on the particular paper being torn. It should be noted that the paper web has only a relatively limited elasticity. As soon as an increase in length by the paper web exceeds the limit of elasticity, the paper web tears. This is also true when the expansion occurs relatively slowly.

According to another embodiment, the explosive device may be mechanically positioned at a location for tearing the web. Thus, an explosive tube may be attached to holding arms which can be pivoted synchronously with a first carrying roll. In this case, the contact of the tube with the winding reel and the uppermost material web layer occurs when the tube is pulled into the wedge-shaped opening. Alternatively, it is possible to utilize carrying arms which have a changeable length, for example, in the form of a pneumatic piston-cylinder unit. In this case, it is possible to pull the tube down onto the paper web lying on the first carrying roll by shortening the carrying arm or by pulling on the springs and then to allow the tube to be further transported by friction with the aid of the paper web. Of course, these two designs may be combined.

Moreover, a control device may be provided for facilitating the positioning of the explosive device in the various positions. Such a control device may take the form of an electronic or electromechanical control unit. Moreover, the control device may receive inputs and/or operate with a cyclometer which determines the number of wound layers on the winding reel such that after a predetermined number of rotations or layers, it actuates and/or initiates the web separation using the explosive device. The invention also contemplates using a diameter measuring device and/or a weighing device which, after a predetermined diameter or weight of the winding reel has been reached, initiates the operation of the separating device. An electronic control device may be provided which functions in basically the same way. Moreover, the electronic control device can be arranged and/or configured to acquire additional information about the overall control of the winding device.

Further, it should be noted that the expansion of the tube can be triggered by various and/or different mechanisms. According to one embodiment, the explosive device is caused to be expanded as a result of a stretching of the springs. This may be accomplished via a switch which may be arranged on the arms which move the explosive. According to another embodiment, the position of the arms is used to trigger the explosive such that when the arms reach the correct position, the tube expands. This may be accomplished via a switch which detects the position of the arms. Thus, for example, when the arms are pivoted far enough that they cross an imaginary line between the midpoint of the first carrying roll and the tearing or explosion site, the expansion can be initiated. The position can be determined by an end position switch that is activated by the arms.

It should be noted that the explosive device may have a variety of configurations even though it is shown in the form of a tube having a circular cross section. The separation occurs in a satisfactory manner using a circular cross section but other cross-sectional shapes may be utilized such as oval, triangular, square, rectangular, or the like.

The invention therefore provides for a process for severing a material web which includes winding the material web onto a reel and severing the material web using an expanding explosive device.

The process may further comprise placing the explosive device between the reel and a last layer of the material web. The process may further comprise rotating the explosive device into a severing position. The severing may occur at the end of winding a material web into a winding reel. The process may further comprise clamping, before the severing, the material web in at least two points. The clamping may comprise positioning two support rolls against the reel, the two support rolls forming a winding bed. The process may further comprise guiding the explosive device through a nip formed between the reel and a roll that is disposed adjacent the reel. The roll may be a support roll which contacts the reel. The process may further comprise one of reusing and retracting the explosive device after the severing. The explosive device may comprise a hose which extends crosswise to the material web. The severing may comprise inflating the hose. The inflating occurs abruptly. The inflating may occur at a speed which can be varied depending on the particular paper being torn. The inflating may occur at a speed which exceeds a limit of elasticity of the material web. The process may further comprise moving the explosive device away from the reel after the severing. The process may further comprise supporting the explosive device via adjustable length pivot arms, and moving the explosive device towards the reel.

The invention also provides for a winding device for winding a material web onto a reel comprising an expandable explosive device for severing the material web, wherein the explosive device is adapted to sever the material web after the material web is wound onto the reel. The device may further comprise at least one roll disposed adjacent the reel. The explosive device may comprises a hose. The hose may be adapted to be inflated with a fluid. The fluid may be air. The explosive device may be coupled to holding arms. The holding arms may comprise one of springs and adjustable length arms. The holding arms may be pivotally mounted. The pivot may comprise an axis of a roll which is disposed adjacent the reel. The explosive device may be adapted to force the material web against a roll disposed adjacent the reel after the material web is severed. The device may further comprise a winding bed formed by at least two support rolls, wherein the explosive device is disposed in the winding bed and between the two support rolls. The device may further comprise a control device adapted to move at least one of the explosive device and a roll disposed adjacent the reel.

The invention also provides for a process for severing a material web in a winding device which includes a winding reel, at least two support rolls forming a winding bed, and a device for severing the material web comprising one of an explosive device and an expanding device comprising winding the material web onto the winding reel in the winding bed, moving the severing device into a severing position between the at least two support rolls, severing the material web, and moving the severing device to another position.

The invention also provides for a device for severing a material web in a winding device comprising a winding reel for winding the material web thereon, at least two support rolls forming a winding bed, and a movable device for severing the material web comprising one of an explosive device and an expanding device, wherein the severing device is adapted to be moved between a severing position between the at least two support rolls and another position.

It should be noted that while the invention is described using a paper web as the example for the material web, it can also be used with webs of different materials.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the drawing by way of a non-limiting example of an exemplary embodiment of the present invention, in which like reference numerals represent similar parts throughout the drawing, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 2:
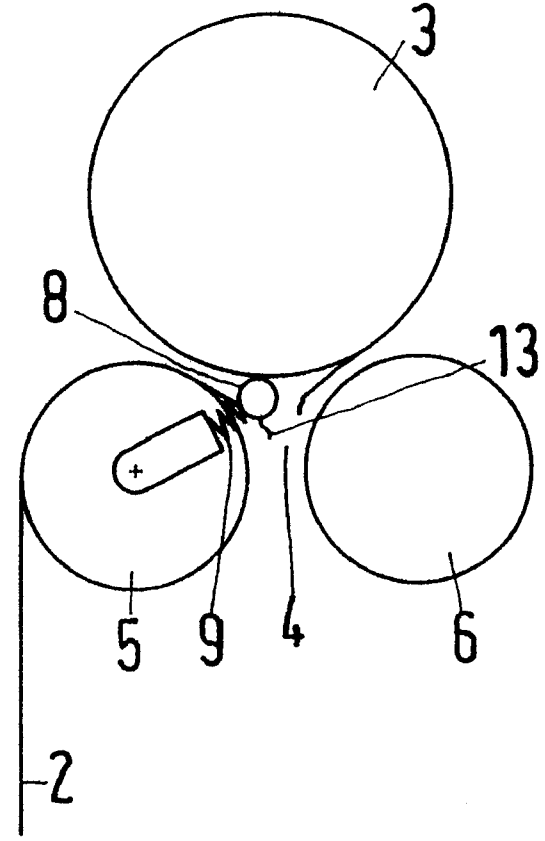
FIG. 2 a schematic view of the winding device during severing of the material web.
Figure 1:
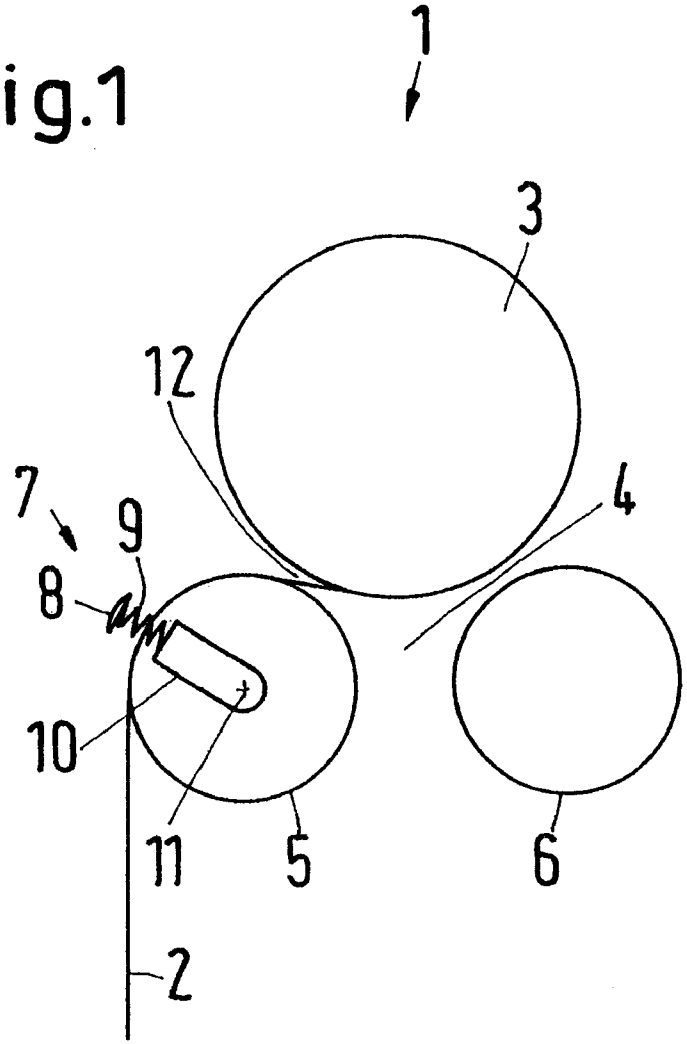
FIG. 1 a schematic view of a winding device before the web is severed.

FIG. 1 depicts a winding device 1 for winding a material web 2 onto a winding reel 3. Winding reel 3 rests in a winding bed 4 which is formed by a first support roll 5 and a second support roll 6. Material web 2 runs over first support roll 5 into winding bed 4. For reasons of clarity, winding reel 3 is depicted at a small distance from two support rolls 5, 6. In reality, winding reel 3 rests against and/or on two support rolls 5, 6 so that the uppermost layer of the material web 2 is squeezed between winding reel 3 and support rolls 5, 6.

A separation device 7 is provided for severing material web 2 in which severing device 7 has a hose 8 which is coupled via a spring to a pair of levers 10, with the levers 10

(only one of them is depicted; the other one is positioned at the other axial end of support roll 5) being pivotal around an axis 11. Axis 11 can, but need not, be identical to an axis of first support roll 5.

When it is required to sever material web 2, hose 8 is lowered onto material web 2, by a mechanism which is not depicted in detail. Thereafter, hose 8 travels together with the web 2 through nip 12 which is formed between winding reel 3 and first support roll 5. Thus, hose 8 is caused to be pinched and/or positioned between the uppermost material web layer and a circumferential surface of winding reel 3. When hose 8 arrives in winding bed 4, springs 9 are tightened as a result of hose 8 moving away from the circumference of first support roll 5.

Hose 8 is then rapidly filled and/or expanded with a fluid medium such as air so that it expands, e.g., preferably rapidly. At the same time, material web 2 is squeezed and/or clamped at two locations, i.e., in front of and behind hose 8 when viewed in the web travel direction. A portion of the outermost layer of web 2 is thus trapped and/or clamped between two support rolls 5, 6 and winding reel 3. As a result, material web 2 contacts the circumference of winding reel 3 tightly before the inflation of hose 8. As discussed above, the inflation of hose 8 causes it to expand. Since there is essentially no space available for this expansion and since no additional material web 2 can be supplied between support rolls 5 and 6, the portion of the web adjacent hose 8 bursts or tears at its weakest point. This point is the material web 2 itself. By expanding hose 8, material web 2 is exploded, so to speak. This creates a tear line which runs essentially parallel to a lengthwise direction of hose 8, i.e., essentially parallel to a rotational axis of winding reel 3. Although the tear does not produce an exact tear having a straight edge like one which is created by cutting, the quality of the bursted or torn edge is acceptable.

After hose 8 has severed material web 2, it can be retracted adjacent first support roll 5 by springs 9. In doing so, it entrains a beginning 13 of material web 2 and may be used to position beginning 13 against a surface of support roll 5. Then, (although not depicted in detail but generally known) a new winding spool or a new reel core may be introduced for winding so that the winding of a new winding reel 3 can begin.

Figure 4:
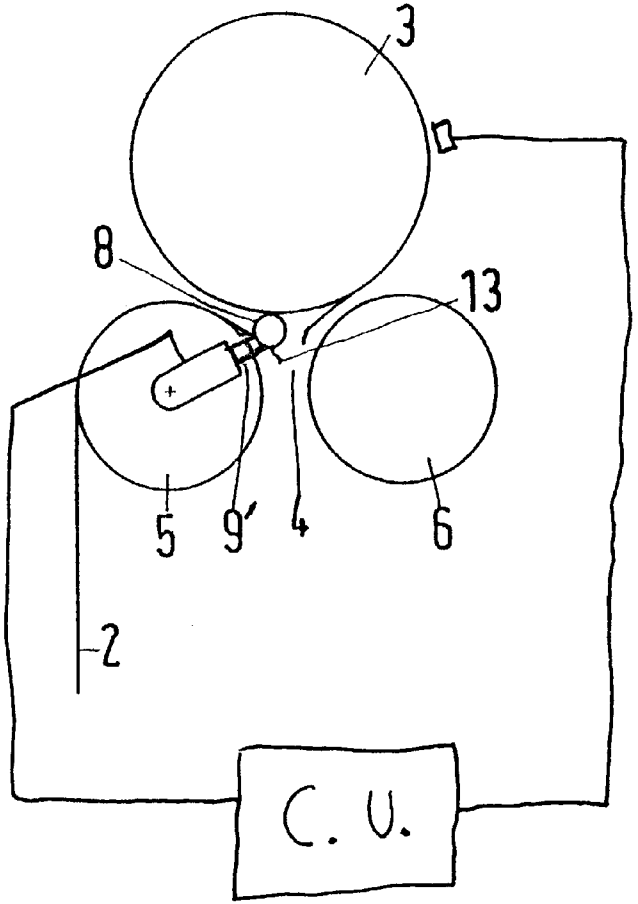
FIG. 4 a schematic view of the winding device of FIG. 3 during severing of the material web.
Figure 3:
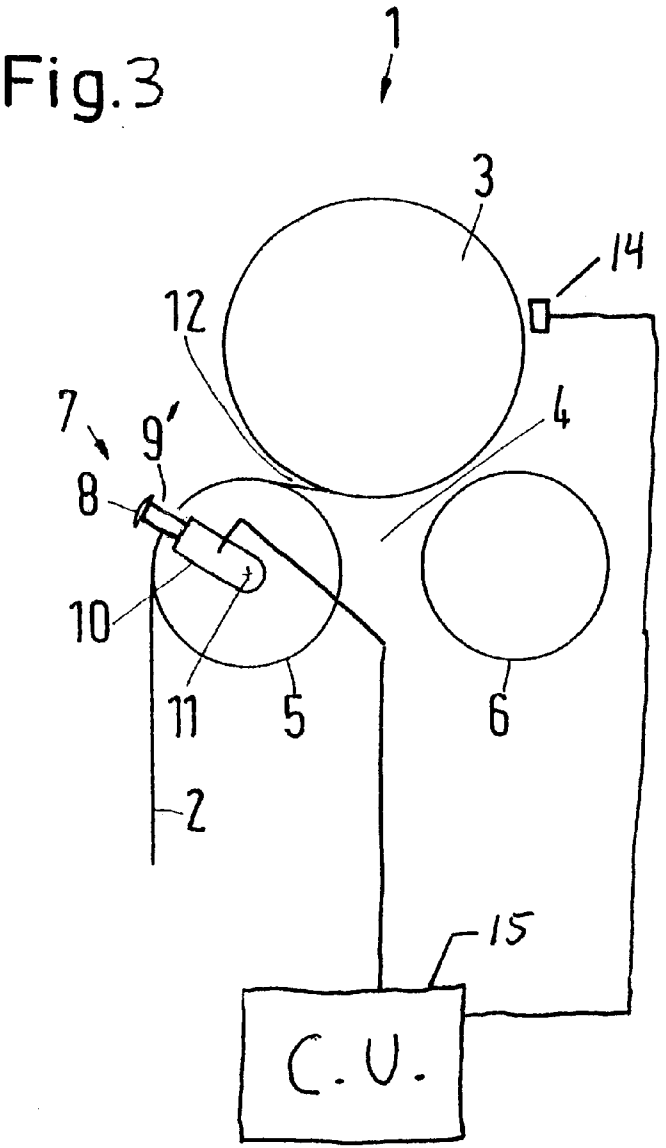
FIG. 3 a schematic view of another winding device before the web is severed, which uses a sensor for determining the number of winding layers, piston/cylinder holding arms, and a control device.

FIGS. 3 and 4 depict a similar winding device 1 for winding a material web 2 onto a winding reel 3. Winding reel 3 rests in a winding bed 4 which is formed by a first support roll 5 and a second support roll 6. Material web 2 runs over first support roll 5 into winding bed 4. For reasons of clarity, winding reel 3 is depicted at a small distance from two support rolls 5, 6. Again, winding reel 3 will rest against and/or on two support rolls 5, 6 so that the uppermost layer of the material web 2 is squeezed between winding reel 3 and support rolls 5, 6. A separation device 7 is provided for severing material web 2 in which severing device 7 has a hose 8 which is coupled via a spring to a pair of levers 10, with the levers 10 (only one of them is depicted; the other one is positioned at the other axial end of support roll 5) being pivotal around an axis 11. Axis 11 can, but need not, be identical to an axis of first support roll 5. When it is required to sever material web 2, hose 8 is lowered onto material web 2, by a mechanism which is not depicted in detail. Thereafter, hose 8 travels together with the web 2 through nip 12 which is formed between winding reel 3 and first support roll 5. Thus, hose 8 is caused to be pinched and/or positioned between the uppermost material web layer and a circumferential surface of winding reel 3. When hose 8 arrives in winding bed 4, adjustable length members which may be in the form of piston/cylinder units 9' are moved as a result of hose 8 moving away from the circumference of first support roll 5.

A control device 15 may be provided for facilitating the positioning of the explosive device in the various positions and for adjusting the length of holding rams 9'. Such a control device 15 may take the form of an electronic or electromechanical control unit. Moreover, control device 15 may receive inputs from a cyclometer 14 which determines the number of wound layers on the winding reel such that after a predetermined number of rotations or layers, it actuates and/or initiates the web separation using the explosive device. The invention also contemplates using a diameter measuring device and/or a weighing device which, after a predetermined diameter or weight of the winding reel has been reached, initiates the operation of the separating device. An electronic control device may be provided which functions in basically the same way. Moreover, the electronic control device can be arranged and/or configured to acquire additional information about the overall control of the winding device.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for severing a material web comprising:

winding the material web onto a reel;

placing an expandable severing device between the reel and a last layer of the material web wound on the reel; and severing the material web using the expandable severing device.

2. The process of claim 1, further comprising:

supporting the expandable severing device via adjustable length pivot arms; and moving the expandable severing device towards the reel.

3. The process of claim 1, further comprising:

rotating the expandable severing device into a severing position.

4. The process of claim 1, wherein the severing occurs at the end of winding a material web onto a winding reel.

5. The process of claim 1, further comprising:

clamping, before the severing, the material web in at least two points.

6. The process of claim 5, wherein the clamping comprises positioning two support rolls against the reel, the two support rolls forming a winding bed.

7. The process of claim 1, further comprising:

guiding the expandable severing device through a nip formed between the reel and a roll that is disposed adjacent the reel.

8. The process of claim 7, wherein the roll is a support roll which contacts the reel.

9. The process of claim 1, further comprising:

one of reusing and retracting the expandable severing device after the severing.

10. The process of claim 1, wherein the expandable severing device comprises a hose which extends crosswise to the material web.

11. The process of claim 10, wherein the severing comprises inflating the hose.

12. The process of claim 11, wherein the inflating occurs abruptly.

13. The process of claim 11, wherein the inflating occurs at a speed which can be varied depending on the particular paper being torn.

14. The process of claim 11, wherein the inflating occurs at a speed which exceeds a limit of elasticity of the material web.

15. The process of claim 1, further comprising:

moving the expandable severing device away from the reel after the severing.

16. A device for severing a material web comprising:

a reel upon which the material web is wound; and an expandable hose that is movable into a position between the reel and a last layer of the material web wound on the reel, wherein the expandable hose tears the last layer when the expandable hose contacts the last layer and expands.

17. A winding device for winding a material web onto a reel comprising:

an expandable severing device for severing the material web, wherein the expandable severing device severs the material web after the material web is wound onto the reel and after being positioned between a last layer wound on the reel and the reel.

18. The device of claim 17, further comprising:

at least one roll disposed adjacent the reel.

19. The device of claim 17, wherein the expandable severing device comprises a hose.

20. The device of claim 19, wherein the hose is adapted to be inflated with a fluid.

21. The device of claim 20, wherein the fluid is air.

22. The device of claim 17, wherein the explosive device is coupled to holding arms.

23. The device of claim 22, wherein the holding arms comprise one of springs and adjustable length arms.

24. The device of claim 22, wherein the holding arms are pivotally mounted about an axis.

25. The device of claim 24, wherein the axis comprises an axis of a roll which is disposed adjacent the reel.

26. The device of claim 17, wherein the expandable severing device is adapted to force the material web against a roll disposed adjacent the reel after the material web is severed.

27. The device of claim 17, further comprising a winding bed formed by at least two support rolls, wherein the expandable severing device is disposed in the winding bed and between the two support rolls.

28. The device of claim 17, further comprising a control device adapted to move at least one of the expandable severing device and a roll disposed adjacent the reel.

29. A process for severing a material web in a winding device which includes a winding reel, at least two support rolls forming a winding bed, and an expandable severing device, the process comprising:

winding the material web onto the winding reel in the winding bed;

moving the expandable severing device into a severing position between the at least two support rolls;

severing the material web; and moving the expandable severing device to another position, wherein the expandable severing device severs the material web after being positioned between the reel and a last layer of the material web wound on the reel.

30. A device for severing a material web comprising:

a winding reel for winding the material web thereon;

at least two support rolls forming a winding bed; and a movable device for severing the material web comprising an expandable severing device, wherein the expandable severing device moves between a severing position between the at least two support rolls and another position, and wherein the expandable severing device severs the material web in the severing position after being positioned between the reel and a last layer of the material web wound on the reel.

31. A process for severing a material web comprising:

winding the material web onto a reel;

placing an expandable hose into a position between the reel and a last layer of the material web wound on the reel; and tearing the material web by expanding the expandable hose, wherein the expandable hose tears the last layer when the expandable hose contacts the last layer and expands.

* * * * *